US006516958B2

(12) United States Patent
Tyski

(10) Patent No.: US 6,516,958 B2
(45) Date of Patent: Feb. 11, 2003

(54) SHELF SYSTEM HAVING HORIZONTALLY ADJUSTABLE SHELVES

(76) Inventor: Wlodzimierz Miroslow Tyski, 883 Borden Rd., Cheektowaga, NY (US) 14227

( * ) Notice: Subject to any disclaimer, the term of this patent is extended or adjusted under 35 U.S.C. 154(b) by 0 days.

(21) Appl. No.: 09/871,060

(22) Filed: May 31, 2001

(65) Prior Publication Data

US 2002/0179557 A1 Dec. 5, 2002

(51) Int. Cl.[7] ..... A47F 5/10; A47B 57/00
(52) U.S. Cl. ..... 211/186; 211/162; 211/175
(58) Field of Search ..... 211/186, 175, 211/162

(56) References Cited

U.S. PATENT DOCUMENTS 865,268 A * 9/1907 Powell ..... 211/175
5,331,904 A * 7/1994 DiSimone et al. ..... 211/175
5,720,399 A * 2/1998 Kohlhaas ..... 211/133.1
6,161,708 A * 12/2000 Myler ..... 211/184

* cited by examiner

*Primary Examiner*—Daniel P. Stodola
*Assistant Examiner*—Erica B. Harris
(74) *Attorney, Agent, or Firm*—Phillips, Lytle, Hitchcock, Blaine & Huber LLP

(57) ABSTRACT

A shelf system (15) comprising a vertical support (16), a horizontal support (18) and a shelf (25), the vertical support, the horizontal support and the shelf being so configured and arranged that the shelf may be selectively positioned at different locations along the horizontal support. The vertical support may comprise a first vertical member (19), a second vertical member (20) and a base (23). The horizontal support may comprise a first horizontal member (21), a second horizontal member (22) oriented parallel to the first horizontal member, the first horizontal member and the second horizontal member defining a gap (24) between them. The shelf may comprise a first top member (26) and a second member (28) extending perpendicular to the first top member. The second member may be so configured and arranged as to fit in the gap.

7 Claims, 1 Drawing Sheet

SHELF SYSTEM HAVING HORIZONTALLY ADJUSTABLE SHELVES

TECHNICAL FIELD

The present invention relates generally to the field of shelving and, more particularly, to an adjustable shelf system.

BACKGROUND ART

A variety of shelf systems are known in the prior art. Generally such shelf systems include two or more vertical support members and a number of horizontal shelves held at each end by the vertical supports. It is known that the vertical position of the shelves may be adjusted by a variety of mechanisms. For example, it is known that the vertical support members may have adjustable brackets that hold each shelf in place and may be positioned at alternate vertical points along the vertical support member.

However, shelf systems known in the prior art do not readily allow for horizontal adjustment of the shelf surface relative to the vertical supports. Hence, it would be useful to provide a shelf system which allows for easy adjustment of its shelving relative to the vertical support member of the shelf system.

DISCLOSURE OF THE INVENTION

With parenthetical reference to the corresponding parts, portions or surfaces of the disclosed embodiment, merely for the purposes of illustration and not by way of limitation, the present invention provides an improved shelf system (15) comprising a vertical support (16), a horizontal support (18), and a shelf (25), the vertical support, the horizontal support and the shelf being so configured and arranged that the shelf may be selectively positioned at different locations along the horizontal support.

The vertical support may comprise a first vertical member (19), a second vertical member (20) and a base (23). The horizontal support may comprise a first horizontal member (21), a second horizontal member (22) oriented parallel to the first horizontal member, the first horizontal member and the second horizontal member defining a gap (24) between them. The shelf may comprise a first top member (26) and a second member (28) extending perpendicular to the first top member. The shelf may have a substantially T-shaped cross-section. The second member may be so configured and arranged as to selectively extend into the gap between the first horizontal member and the second horizontal member. The gap between the first horizontal member and the second horizontal member may have a width (30) of approximately 1.5 inches and the width (29) of the second member may be slightly less than 1.5 inches. The first top member, the second member, the first horizontal member and the second horizontal member may have rectangular cross-sections. The horizontal support may have a cylindrical throughbore and the shelf may have a member with a circular cross-section that fits in the throughbore.

Accordingly, the object of the present invention is to provide an improved shelf system in which the shelves may be positioned at alternate horizontal locations relative to the vertical support members and/or horizontal support members.

Another object is to provide an improved shelfsystem in which the shelves do not extend the full length of the horizontal support members.

Another object is to provide an improved shelf system in which the support members for the shelves is not as prominent to the viewer.

Another object is to provide an improved shelf system which may be used to hold numerous objects such as plants, figurines, and other decorative or utilitarian items.

Another object is to provide an improved shelf system which is sturdy and secure.

These and other objects and advantages will become apparent from the foregoing and ongoing written specification, the drawings, and the appended claims.

DESCRIPTION OF THE PREFERRED EMBODIMENTS

Figure 1:
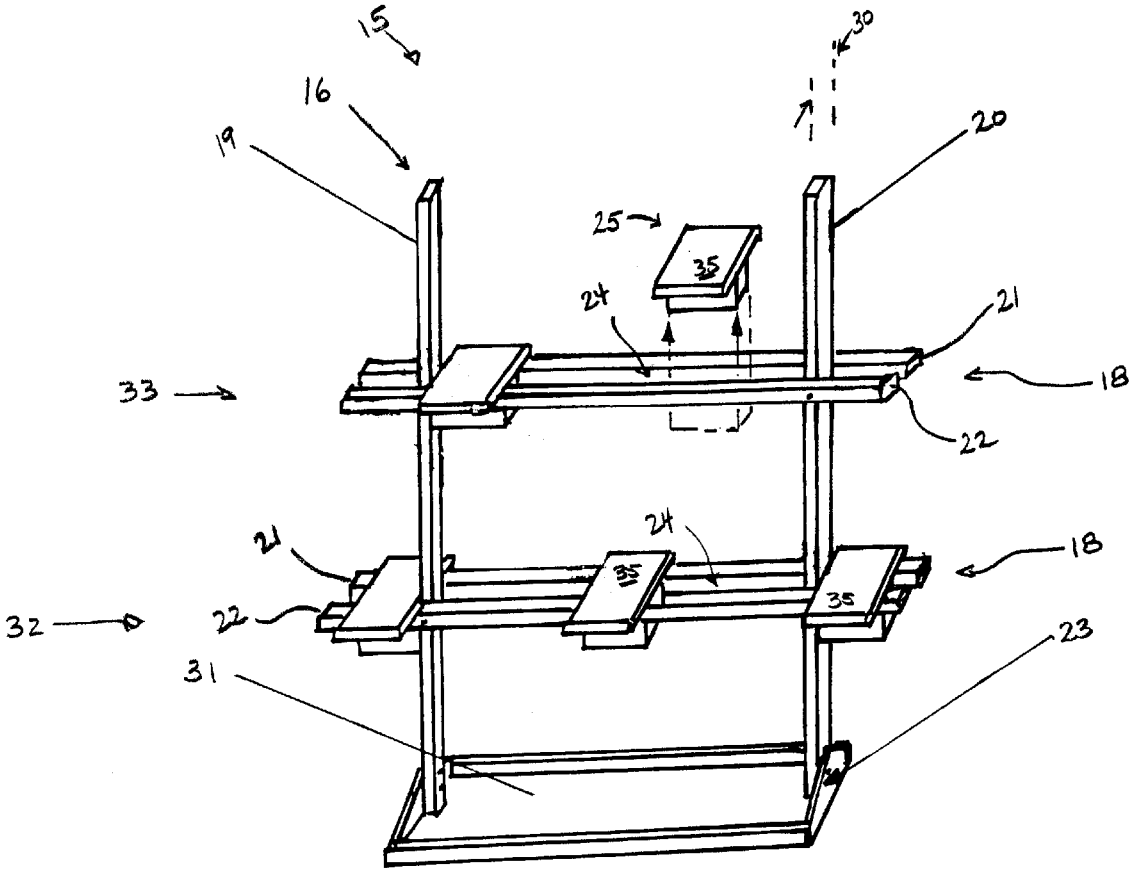
FIG. 1 is a prospective view of the improved shelf system.

At the outset, it should be clearly understood that like reference numerals are intended to identify the same structural elements, portions or surfaces consistently throughout the drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.) simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings and, more particularly, to FIG. 1 thereof, this invention provides an improved shelf system which allows for the selective horizontal adjustment of shelving, the presently preferred embodiment of which is generally indicated at 15. Shelf system 15 is shown as broadly including a vertical support 16, two horizontal supports 18, and a number of shelves 25. Vertical support 16 is formed by a first vertical support member 19, a second vertical support member 20, and a base platform 23. Vertical support members 19 and 20 are rectangular shaped elongated members that are spaced apart and oriented vertically and parallel to each other. Base platform 23 is a shallow box-like base having four shallow sides extending perpendicularly from the edges of a base plate 31. Each of vertical members 19 and 20 are bolted at the bottom end to the center of the left and right sides of base 23, respectively. The ends of members 19 and 20 rest on the top surface of base plate 31. The area inside of base 23 may be filled with gravel or other aggregates to add weight and stability to shelf system 15.

In the preferred embodiment, horizontal support 18 consists of two horizontal members 21 and 22 that extend horizontally between vertical supports 19 and 20. The left and right ends of members 21 and 22 extend beyond vertical members 19 and 20, respectively. FIG. 1 shows a shelving system having a first level 32 and a second level 33. While the preferred embodiment includes two levels, it is readily apparent that the number of levels may be varied, as may the number of vertical support members.

As shown, levels 32 and 33 are comprised of two horizontal support members 21 and 22. Support members 21 and 22 are positioned the same distance above the base of shelf system 15 and extend parallel to each other. Horizontal support member 22 is positioned on the front side of vertical supports 19 and 20 and horizontal member 21 is positioned on the back side of vertical supports 19 and 20. Accordingly, horizontal support 21 and horizontal support 22 are separated by a gap 24. Gap 24 has a width 30 which is equivalent to the transverse width of vertical support members 19 and 20. Horizontal supports 21 and 22 are bolted to vertical supports 19 and 20 at their junctions. Although not shown, additional bolt holes may be drilled through vertical support members 19 and 20 at equal distances along vertical supports 19 and 20 such that additional layers may be bolted to shelf system 15 or the existing layers may be either lowered or raised relative to base 23.

As shown in FIG. 1, a number of shelves are positioned along support 18. In the embodiment shown in FIG. 1, three independent shelves 25 are positioned on layer 32 and two independent shelves are positioned on layer 33.

Figure 2:
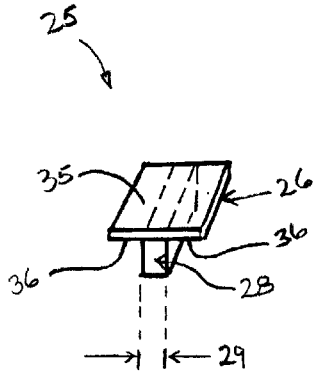
FIG. 2 is a prospective view of the shelf shown in FIG. 1.

As shown in FIG. 2, in the preferred embodiment shelves 25 are formed of a first top plate 26 and a second plate 28 that is fixed to the bottom surface 36 of top plate 26 and extends perpendicular to bottom surface 36. Various objects may be placed on the top surface 35 of plate 26.

Second plate 28 is a substantially rectangular transverse width 29. As shown in FIG. 1, shelves 25 may be selectively positioned on horizontal support 18 by aligning plate 28 in the same longitudinal direction as support members 21 and 22 and inserting plate 28 in the gap 24 between first horizontal support member 21 and second horizontal support member 22. As shown, the width 29 of plate 28 is only slightly less than the width 30 of gap 24. When in place, bottom surface 36 of plate 26 rests on the top surface of horizontal support members 21 and 22. The end of plate 28 extends a short distance below the plane of the bottom surfaces of horizontal support members 21 and 22. As shown in FIG. 1, shelves 25 may therefore be moved either to the left or right along horizontal support 18. One or more shelves may be added or removed depending on the desired orientation of the shelving. In addition, one or more shelves may be placed along the portions of the ends of support members 21 and 22 that extend to the right and left of vertical support members 19 and 20, respectively. As shown, shelves 25 may be used on level 32 or 33 interchangeably. Shelves 25 are held in place by their own weight, including the weight of any objects placed on them, and the frictional contact between the sides of plate 28 and the inside surfaces of support members 21 and 22, respectively, as well as the frictional contact between bottom surface 36 and the top surfaces of members 21 and 22. In the preferred embodiment, the transverse width of horizontal support members 19 and 20, and thus the width 30 of gap 24, is approximately 1.5 inches. The width 29 of plate 28 is only slightly less than 1.5 inches.

As shown in FIGS. 1 and 2, each of vertical support members 19 and 20 and horizontal support members 21 and 22 and plates 26 and 28 have rectangular cross-sections. In the preferred embodiment, vertical support members 19 and 20 as well as horizontal support members 21 and 22 are 2"×4" wooden boards. However, it is readily apparent that such support members as well as shelf 25 may be made of plastic, metal, or other composite materials. In addition, rather than being bolted, horizontal support members 21 and 22 may be attached to vertical support members 19 and 20 by screws or nails. Plate 28 may have the same dimensions and be made of the same material as horizontal support members 19 and 20 so as to fit snugly in gap 24 between horizontal support members 21 and 22. Horizontal support members 21 and 22 not only provide vertical support for shelves 25, but also add additional lateral stability to shelf system 15.

Modifications

The present invention contemplates that many changes and modifications may be made. The particular materials of which the various body parts and component parts are formed are not deemed critical and may be readily varied. The dimensions of the preferred embodiment may be readily altered as may the cross-sectional configuration of the support members and the spacing of the shelves. In addition, the number of shelves and/or support members may be readily altered.

Therefore, while the presently-preferred form of the shelving system has been shown and described, and several modifications thereof discussed, persons skilled in this art will readily appreciate that various additional changes and modifications may be made without departing from the spirit of the invention, as defined and differentiated by the following claims.

What is claimed is:

1. A shelf system comprising:

a vertical support having a first vertical member and a second vertical member;

a horizontal support having a first horizontal member and a second horizontal member oriented parallel to said first horizontal member;

said first horizontal member and said second horizontal member having a gap between them;

said first vertical member and said second vertical member extending into and defining the width of said gap between said first horizontal member and said second horizontal member;

a shelf supported by said first horizontal member and said second horizontal member;

said vertical support, said horizontal support and said shelf being so configured and arranged that said shelf may be selectively positioned along said horizontal support.

2. The shelf system set forth in claim 1, wherein said vertical support further comprises a base.

3. The shelf system set forth in claim 1, wherein said shelf comprises a first top member and a second member extending perpendicular to said first top member.

4. The shelf system set forth in claim 3, wherein said first top member, said second member, said first horizontal member and said second horizontal member have rectangular cross-sections.

5. The shelf system set forth in claim 3, wherein said shelf has a substantially T-shaped cross-section.

6. The shelf system set forth in claim 3, wherein said second member is so configured and arranged as to selectively extend into and substantially fill said gap between said first horizontal member and said second horizontal member.

7. The shelf system set forth in claim 6, wherein said gap between said first horizontal member and second horizontal member has a width of approximately 1.5 inches and the width of said second member is slightly less than 1.5 inches.

* * * * *